United States Patent [19]

Knoke

[11] 4,103,374

[45] Aug. 1, 1978

[54] BED FRAME LEG CONSTRUCTION

[75] Inventor: Silas J. Knoke, Seymour, Ind.

[73] Assignee: Lear Siegler, Inc., Santa Monica, Calif.

[21] Appl. No.: 785,583

[22] Filed: Apr. 7, 1977

[51] Int. Cl.[2] ..... A47B 19/02; A47B 19/04

[52] U.S. Cl. ..... 5/176 R; 5/202; 5/310

[58] Field of Search ..... 5/310, 200 R, 202, 176 R, 5/176 B; 248/188

[56] References Cited

U.S. PATENT DOCUMENTS

| | | | |
|---|---|---|---|
| 2,825,073 | 3/1958 | Harris | 5/310 |
| 2,851,702 | 9/1958 | Imber et al. | 5/202 |
| 2,857,602 | 10/1958 | Quintana | 5/202 |
| 3,004,265 | 10/1961 | Silverman et al. | 5/176 R |
| 3,100,304 | 8/1963 | Brandlin et al. | 5/202 |
| 3,559,938 | 2/1971 | Harris | 248/188 |

*Primary Examiner*—Paul R. Gilliam
*Assistant Examiner*—Alex Grosz
*Attorney, Agent, or Firm*—Reising, Ethington, Barnard, Perry & Brooks

[57] ABSTRACT

A leg construction for a folding bed frame is disclosed in which a sheet metal leg is received generally within the confines of an angle iron end rail and is secured to the inside surface of the end rail. An upper portion of the leg is supported in underlying relation to the horizontal member of the end rail for additional support. An integral tab on the leg extends upwardly through a slot in the end rail and provides a positive stop for engagement with the adjacent pivotally attached side rail to define a right angled position between the end and side rails.

3 Claims, 6 Drawing Figures

BED FRAME LEG CONSTRUCTION

BACKGROUND OF THE INVENTION

This invention relates to folding bed frames of the Hollywood type and more particularly to an improved leg construction for use with such frames having angle iron end rails. Angle iron railing is commonly employed in the manufacture of low cost folding bed frames due to its availability and its high strength. Commonly, legs have been provided on such end rails for supporting the bed frame, and in some instances, the legs have combined with stop members to define a right angled or erected position of the side rail on the end rail. However, such legs have commonly been attached to the outside vertical surface of the end rail, and the support of such legs on the rails has been exclusively on the side flange through rivets or the like.

SUMMARY OF THE INVENTION

The present invention is directed to an improved folding bed frame and more particularly to an improved leg construction in combination with angle iron end rails in which the leg is positioned in underlying and interfitted relation to the associated end rail and, in the transverse sense, is confined under or nested within the flange dimensions of the end rail. Thus, the upper portion of the leg is received in underlying relation to the horizontal flange of the end rail and derives support therefrom. Further, an integral tab is formed on the leg and extends upwardly through an access opening or slot. The tab defines a stop member for engagement with the adjacent edge of the side rail when the end rail is folded and when it is moved to a right angled position.

An object of the invention is the provision of a bed frame, as outlined above, having a leg supported within the confines of an angle iron end rail, such leg also providing a stop to define the opened and folded positions of the rails.

Another object of the invention is the provision of an improved leg construction for use with an angle iron end rail of a bed frame which is capable of being manufactured at low cost and which has improved strength as compared to legs mounted exteriorly of the end rail.

These and other objects and advantages of the invention will be apparent from the following description, the accomanying drawings and the appended claims.

DESCRIPTION OF THE PREFERRED EMBODIMENT

Figure 1:
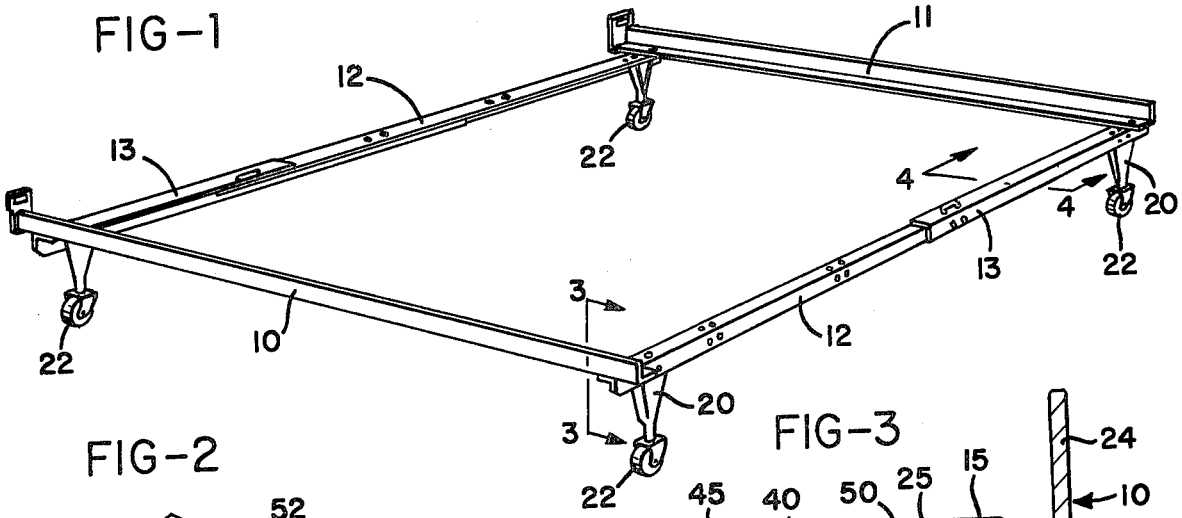
FIG. 1 is a perspective view of a folding bed frame with legs constructed according to this invention.

Referring to FIG. 1, a Hollywood type bed frame is shown as having a pair of identical angle iron side rails 10 and 11. Each of the side rails supports a pair of end rails including an inner end rail 12 and an outer end rail 13. When the bed frame is in use, the end rails 12 and 13 are interfitted and locked in preadjusted position, and for this purpose, the end rail locking and retaining structure of my copending application Ser. No. 785,079, filed concurrently herewith, may be used advantageously.

The end rails 12 and 13 are also of angle iron construction. The end rails are pivotally mounted on the side rails on attaching rivets 15 (FIG. 3) which provide for movement of the respective end rails from positions in which they are substantially parallel to the side rail, to erected positions, as shown in FIG. 1, in which they are substantially normal to the side rail.

Figure 2:
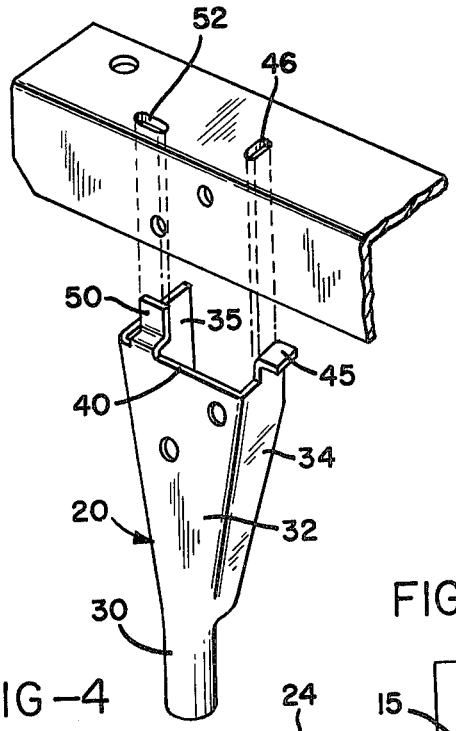
FIG. 2 is a perspective fragmentary exploded view of the leg and end rail assembly.

The bed frame of this invention is characterized by a support leg construction which not only supports the bed frame in elevated relation to the floor, but also provides an integral stop to define the folded and extended positions of the end rails. The legs are illustrated generally at 20 in FIG. 1, and in greater details in FIGS. 2–4. The legs 20 may receive conventional castors 22. For the purpose of illustration and explanation, only one leg and end rail construction will be described.

Figure 3:
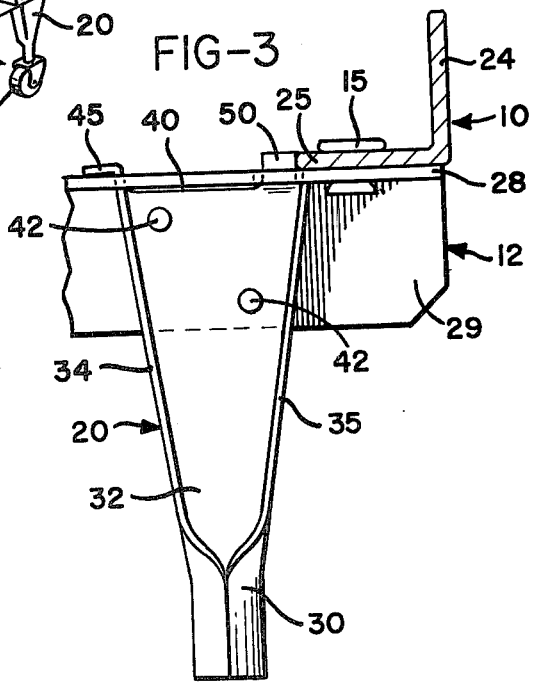
FIG. 3 is a fragmentary sectional view looking generally along the line 3—3 of FIG. 1.
Figure 4:
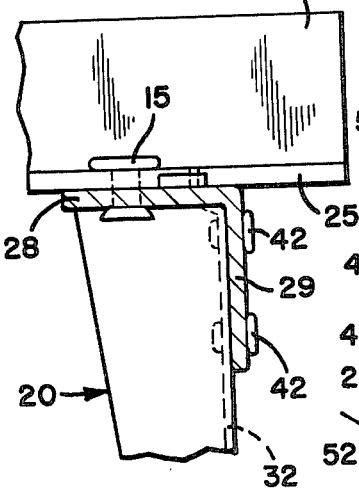
FIG. 4 is another fragmentary sectional view looking generally along the line 4—4 of FIG. 1.

As shown in FIG. 3, the side rails form an upstanding side flange 24 and a horizontal bottom flange 25. The end rails are turned with respect to the side rails and thus present a horizontal flange 28 and a depending flange 29. The end rails, at their ends, underlie the side rails, and the pivotal attachment rivet 15 extends through the bottom flange 25 of the side rail and the horizontal flange 28 of the end rail.

The leg 20 of this invention is formed of rolled sheet metal and has a closed generally cylindrical castor-socket receiving bottom portion 30. The portion 30 receives a conventional castor socket, not shown, for supporting the castor 22. The portion 30 flares into a generally flat tapered back wall 32 and a pair of laterally extending side walls 34 and 35. The side walls taper outwardly with increasing spacing from the socket receiving portion 30 and the back wall also tapers transversely outwardly along with the side walls so that the leg is widest at its top. However, the maximum depth of the side walls 34 and 35 does not substantially exceed the transverse internal width of the horizontal flange 28 of an end rail, and thus the side walls, at their widest portion, preferably extend a distance which is not greater than that of the inside dimension of the overlying horizontal leg of the end rail so that the upper portion of the leg is disposed within the confines of the end rail.

The upper portion of the leg 20 along a major portion of the back wall 32, along the upper edge of the side 35, and along a portion of the side 34 forms a generally flat U-shaped rail-contacting surface 40 which is received adjacent the lower or inside surface of the horizontal flange 28. A pair of rivets 42 attach the leg 20 at the back wall 32 thereof firmly against the inside surface of the depending flange 29 of the side rail.

The leg 20, on the side wall 35 remote from the side rail, is provided with an integral upwardly and outwardly turned tab 45. The tab 45 is received through a transverse access slot 46 formed in the flange 28 and extends outwardly in overlying relation to the horizontal flange, as shown in FIG. 3, for locating and supporting the leg on the side rail.

Figure 5:
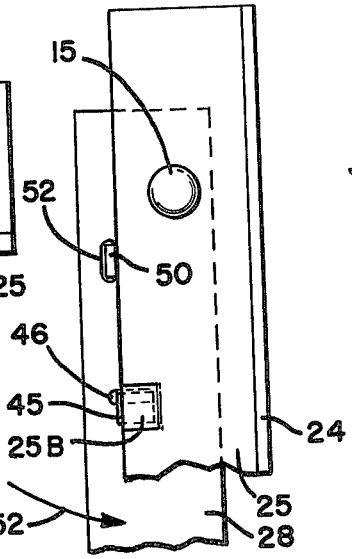
FIG. 5 is a fragmentary plan view showing the side rail and end rail in the folded position.
Figure 6:
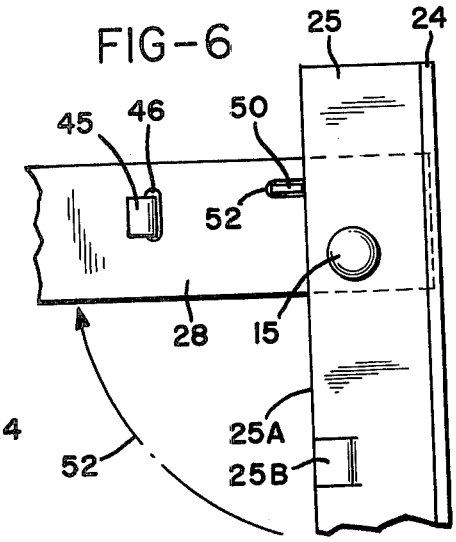
FIG. 6 is a view similar to FIG. 5 showing the parts in the erected position.

The back wall 32 is provided with an integral, inwardly and upwardly extending stop member 50. The member 50 is proportioned to be received within and to extend through a second elongated slot means 52 formed in the horizontal flange 28. When the leg 30 is assembled on the side rail, the stop member 50 extends slightly above the upper surface of the horizontal flange 28, as shown in FIG. 3. The stop member 50 is positioned in transversely offset relation to the axis defined by the rivet 15. It has two stop functions as well as a stabilizing and locating function of the leg 20 with respect to the associated rail. First, the stop 50 is proportioned to engage the edge 25*a* of the rail 10 when the side rail is in the folded position, as shown in FIG. 5, in which the associated end rails and side rails are substantially parallel to each other. In this position, an outwardly indented portion 25*b* is formed in the flange 25 to receive the tab 45. When the frame is set up, the end rails are moved in the direction of the arrow 52 to the right angled position, as shown in FIG. 6. Now, the rear edge of the stop member 50 comes into engagement with the edge 25*a* of the rail flange 25, thus defining the erected or right angled position of the rails.

The improved leg construction of this invention thus has several advantages. Since the upper portion thereof is confined within the dimensions of the end rails, there are no upper protruding parts of the leg. Further, since the upper portion of the leg defines a generally U-shaped contacting surface, substantial strength is gained by reason of the nesting of the leg within the angle formed by the side rails so that the strength of the leg is not limited to the strength of the rivets by which it is attached to the depending flange 29, but is enhanced by the direct support received by the leg from the horizontal flange 28. The tab 45 and the stop member 50 also serves the function of locating and supporting the leg 20 on the side rail while the stop 50 provides the additional function of defining the folded and opened positions of the side rails.

While the form of apparatus herein described constitutes a preferred embodiment of this invention, it is to be understood that the invention is not limited to this precise form of apparatus, and that changes may be made therein without departing from the scope of the invention.

What is claimed is:

1. In a folding bed frame having an angle iron end rail pivotally attached in underlying relation to a side rail for movement between a folded position in which the end rail is adjacent to the side rail and an erected position in which the end rail is normal to the side rail, and in which said end rail has a horizontal flange and a vertically depending flange, the improvement in frame supporting structure comprising, a sheet metal support leg having a castor-receiving socket portion at the bottom flaring into a generally flat tapered back wall and a pair of laterally-extending side walls, said back wall being received against an inside surface of the depending flange of said end rail, said side walls tapering from said socket portion upwardly to the top of said leg, rivet means extending through said back wall and said depending side rail flange fixing said back wall in abutment with the inside surface of said depending flange, said back wall being provided with an inwardly and upwardly extending stop member, and slot means in said horizontal flange receiving said stop member therethrough, said stop member being positioned to engage said side rail when the associated end rail is positioned in right angled relation thereto.

2. The frame of claim 1 in which said stop member is positioned to engage said side rail to define the folded position of said rails.

3. In a folding bed frame having an angle iron end rail pivotally attached in underlying relation to a side rail for movement between a folded position in which the end rail is adjacent to the side rail and an erected position in which the end rail is normal to the side rail, and in which said end rail has a horizontal flange and a vertically depending flange, the improvement in frame supporting structure comprising, a sheet metal support leg having a castor-receiving socket portion at the bottom flaring into a generally flat tapered back wall and a pair of laterally-extending side walls, said back wall being received against an inside surface of the depending flange of said end rail, said side walls tapering from said socket portion upwardly to the top of said leg, said side walls extending laterally at the widest portion thereof a distance no greater than the inside dimension of the overlying horizontal flange of the end rail so that the upper portion of the support leg is disposed within the confines of the end rail, and rivet means extending through said back wall and said depending side rail flange fixing said back wall in abutment with the inside surface of said depending flange, said side wall remote from said side rail being provided with an upwardly and outwardly turned tab, means in the horizontal flange of the end rail defining an access slot, said tab extending through said access slot and in overlying relation to said horizontal leg for locating and supporting said support leg, said back wall being provided with an inwardly and upwardly extending stop member, and second slot means in said horizontal flange receiving said stop member therethrough, said stop member being positioned to engage said side rail when the associated end rail is positioned in right angled relation thereto to define the erect position thereof.

* * * * *